US006099443A

United States Patent [19]

Landfair

[11] Patent Number: 6,099,443

[45] Date of Patent: Aug. 8, 2000

[54] FIXED-HEAD DUMBBELL

[75] Inventor: Craig D. Landfair, Ventura, Calif.

[73] Assignee: Hampton Fitness Products, Ltd., Ventura, Calif.

[21] Appl. No.: 09/356,393

[22] Filed: Jul. 16, 1999

Related U.S. Application Data

[60] Provisional application No. 60/093,728, Jul. 22, 1998.

[51] Int. Cl.[7] ..... A63B 21/075

[52] U.S. Cl. ..... 482/108; 482/107

[58] Field of Search ..... 482/50, 93, 106–109

[56] References Cited

U.S. PATENT DOCUMENTS 1,019,584 2/1912 Balston ..... 482/108

5,823,922 10/1998 Eckmann ..... 482/108

*Primary Examiner*—John Mulcahy

*Attorney, Agent, or Firm*—J. Charles Dougherty

[57] ABSTRACT

An improved dumbbell having a bar with permanently and securely attached weighted heads is disclosed. A pin passing through a bore in the weighted heads and each end of the bar holds the weighted heads securely in place. The weighted heads have a circumference of circular shape, and are coated with a resilient material. The exterior surface of the resilient material has a multi-sided circumference. The circular shape of the circumference of the weighted heads prevents the weighted heads from digging into the resilient coating when the dumbbell is in use or is dropped.

8 Claims, 1 Drawing Sheet

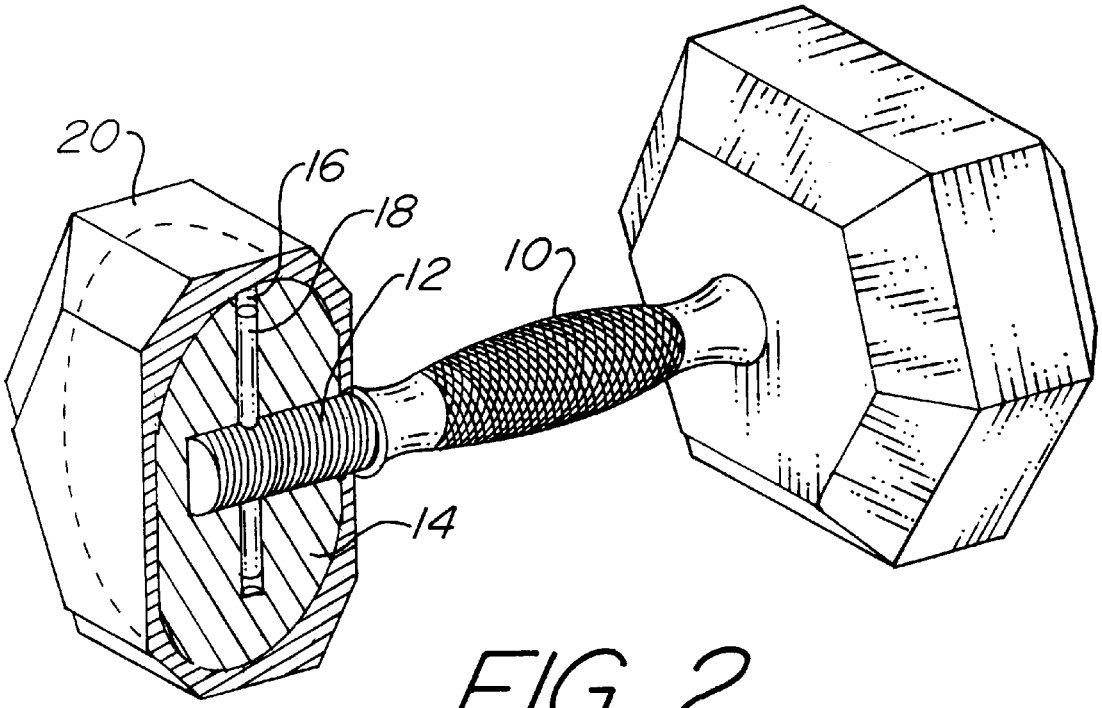
FIG. 2
FIG. 1
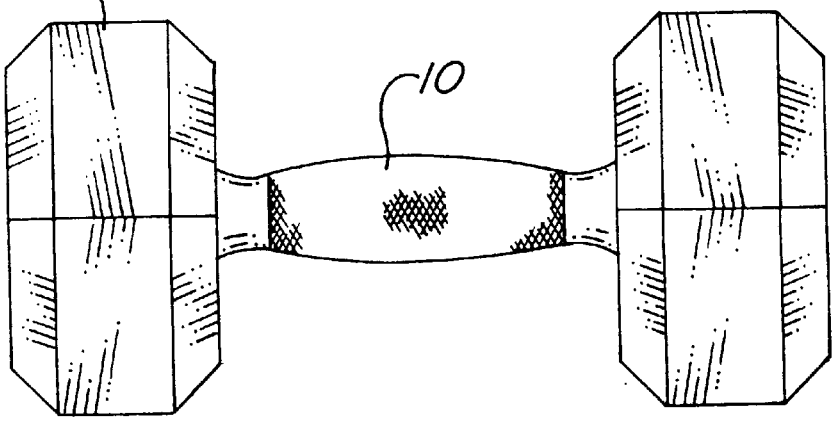

FIXED-HEAD DUMBBELL

This application claims the benefit of provisional application Ser. No. 60/093,728, filed Jul. 22, 1998.

FIELD OF THE INVENTION

The present invention relates to exercise devices, and in particular relates to dumbbells with fixed weighted heads.

BACKGROUND OF THE INVENTION

Although dumbbells and barbells are among the oldest forms of equipment used for physical conditioning, they remain extremely popular, not only for use in professional weight training, but also for fitness and exercise routines for casual users, as well as physical rehabilitation. Numerous types of dumbbells are known in the art. A dumbbell is generally a weight-training device consisting of a bar with weighted heads attached at or near either end of the bar. The user grips the bar at its midsection and may perform a variety of exercises by lifting the dumbbell in various manners. Typically, a dumbbell has a shorter bar and is designed for one-handed use, while a barbell has a longer bar and is designed for use with both hands. Dumbbell and barbell bars may be straight, curved, or may be ergonomically shaped to snugly fit the hand of the user. Dumbbells may be used alone, but may also be used in pairs to, for example, improve the strength-building characteristics of certain calisthenic exercises.

A critical concern in the design of any weight equipment, and in particular dumbbells and barbells, is the safety of the user. Perhaps the most significant safety issue associated with dumbbell and barbell design is the potential for one of the weighted heads to separate from the bar during use. Dumbbells are under constant motion and stress as the user moves through various exercise regimens. The repetitive activity involved with most common exercises increases the likelihood that a loose weighted head will slowly work its way off of the bar. In addition, dumbbells and barbells are commonly banged into other equipment, equipment stands, and the floor during use, further increasing the chance that the weighted heads will loosen and fall from the bar. Serious injury may result to the user or to bystanders when the heavy weighted heads separate from the bar. Such injury may be the result of a weighted head falling onto the user or a bystander, or may be the result of the violent reaction of the bar when the weight on one end is suddenly released. In addition to personal safety, another important concern is the damage caused to floors and other equipment if weighted heads fall from a dumbbell or barbell during use. For these reasons, the means of attaching the weighted head to the dumbbell bar is critical.

An older method for attaching weighted heads to barbells and dumbbells, less popular today, is to slide the weighted heads onto the bar, and follow the weighted head with a collar. The collar has a set screw mounted perpendicularly to the bar, and by tightening the set screw, the weighted head is held in place. This method is convenient for the user who often changes weighted heads, but is quite dangerous, since repetitive use will quickly loosen the set screw, causing the collar to loosen and eventually allowing the weighted head to fall from the bar.

One common means of attaching weighted heads to barbells and dumbbells today is to use a bar with interior threads on each end. The weighted heads are slid over the bar on each end up to a stop located on the bar. A bolt is threaded through an end cap, and then the bolt is threaded into the dumbbell bar. The end cap may be pulled up tight against the weighted head by tightening the bolt. Although this method of attaching weighted heads is popular, it can present a significant safety concern as discussed above because the bolt may work loose through repeated use and cause the weighted head to separate from the bar.

The general safety practice when using dumbbells with bolted endplates is to establish a maintenance schedule whereby the bolts on each dumbbell are periodically tightened. However, this solution is undesirable because of the possibility of human error in failing to tighten the bolts according to the appropriate schedule, or by failing to properly tighten each bolt when the scheduled maintenance is performed. Moreover, periodic tightening of the endcap bolts adds additional labor costs to the maintenance of a fitness or weight-training facility. Finally, the requirement of a maintenance schedule is a particularly poor solution for dumbbells sold to home users, since these persons are less likely to follow recommended safety maintenance procedures. Home users are less familiar with weight-training equipment safety procedures than are the personnel at professional fitness and weight-training facilities, thus exacerbating this problem.

In an attempt to address the problems caused by the loosening of weighted heads, some dumbbell manufacturers now produce dumbbells in which the weighted head and handle are molded as a single, integrated piece. While reducing the likelihood that a weighted head will separate from the bar, this approach also has disadvantages, particularly related to manufacturing cost. Often a manufacturer wishes to use an attractive metal to form the exposed portions of a dumbbell. Stainless steel is one example of such a metal. Potential purchasers are more likely to choose an attractive piece of equipment when selecting from among the many choices available in today's competitive marketplace for fitness equipment. Since the attractiveness of the available training equipment is also an important factor for most consumers in choosing a gymnasium, gymnasium owners also find that the relative attractiveness of their equipment is important.

The weighted heads on dumbbells are commonly coated with rubber, or some other resilient material, to reduce the resulting damage when the barbell is dropped or banged into other equipment. Resilient coatings also serve to reduce the noise caused by metal equipment banging together in a gymnasium environment. When such a coating is applied, the metal portion of the weighted head may no longer be visible to the user. If the dumbbell weighted heads are formed separately from the bar, then the bar may be constructed of an attractive, expensive metal, while the weighted heads may be constructed of less attractive, but less costly, metals. This manufacturing technique may be used to significantly reduce the overall cost of producing a dumbbell, while maintaining its attractive appearance. Since the resilient coating may cover the weighted head in its entirety, the appearance of the dumbbell is not degraded even though the less-expensive metal is used for the dumbbell weighted heads. If, however, the weighted heads and bar of the dumbbell are formed as a single, integrated piece, then the entire barbell must be formed of the expensive, attractive metal, thereby significantly driving up the manufacturing cost of the dumbbell. Since most of the metal used in producing a dumbbell is found in the weighted heads, not the bar, using an expensive metal for the entire dumbbell will greatly increase the cost of the product. Although forming the weighted heads and bar separately allows the manufacturer to reduce cost by reducing the proportion of expensive metals used during manufacture, the problems discussed above that are associated with attaching the weighted heads must still be addressed.

Because of the high manufacturing cost associated with dumbbells formed entirely of expensive metals, some manufacturers choose to simply produce integrated dumbbells from less expensive metals, such as soft iron, and then paint the entire dumbbell. Another alternative is to simply coat the entire dumbbell in a resilient material. Many consumers find such dumbbells less attractive than those with bars formed from more attractive metals; this is particularly true among serious weight-training enthusiasts. In addition, painted dumbbells are prone to the problem of paint flaking or chipping from the weighted heads and bar through repetitive use and contact with other equipment.

Another attempted solution to the problem of securely attaching weighted heads to the bar is to simply weld the weighted heads in place. This approach is undesirable for several reasons. First, the weld seam resulting from this process is unsightly, and detracts from the appearance of the dumbbell. Also, in the case of a dumbbell that is formed of an attractive metal, the weld will discolor the metal around the weld seam. This same discoloring problem arises when the dumbbell bar is coated in a metallic material, such as zinc chromate. Finally, welding is not a complete solution to the safety issue of the weighted head separating from the bar, since welds will eventually crack and break through repetitive use. Thus a dumbbell with the weighted heads permanently locked securely in place, which may be manufactured inexpensively, and which may be formed of or coated with attractive materials, is desired.

Another problem encountered with dumbbells today pertains to the resilient material commonly used to coat dumbbell weighted heads. In the past, virtually all dumbbells had weighted heads that had a circular circumference, and thus were more-or-less disc-shaped. Today, while some dumbbells still follow this traditional design, others have weighted heads that have a multi-sided circumference, thus forming, for example, hexagonal or octagonal plates. The principal behind this design is the same as that for the shape of an ordinary wooden pencil—the multi-sided form reduces the likelihood of the item rolling away when it is dropped or placed on a flat surface. This is an important safety issue, since a dropped dumbbell having weighted heads with a circular circumference could roll a considerable distance, and thereby strike another person or piece of equipment far from the dumbbell's user.

A problem arose when manufacturers began using weighted heads having a multi-sided circumference in combination with resilient coatings. It has been found that the resilient material on such weighted heads wears very quickly. The resilient materials used are necessarily soft and pliable, and thus do not stand up well to tearing or shearing forces. If a dumbbell with weighted heads coated in such a material is dropped, the sharp edges formed by two sides joining along the multi-sided circumference of the weighted heads tend to dig into the resilient material, thereby significantly reducing the life of the coating. This problem is exacerbated by the significant weight of the dumbbell, which serves to drive the sharp edge of a weighted head deeper into the resilient material when a drop occurs. Even under normal use, if the dumbbell is scooted across or even pressed against a surface, the force applied to the barbell will press the inside surface of the resilient material against the sharp edges on the weighted head portion, thus cutting into the resilient material from the inside and reducing the life of the coating. It is seen then that a method of forming a dumbbell having weighted heads with a multi-sided circumference, combined with a long-life resilient coating, is desired.

SUMMARY OF THE INVENTION

The present invention overcomes the limitations of the prior art by providing a dumbbell in which the weighted heads and bar may be formed separately, but in which the bar and weighted heads are securely and permanently attached. The bar of the present invention is preferably threaded on either end, and designed to thread into interior threads provided in a lateral bore in each weighted head. A bore is drilled through the weighted head from one exterior edge, perpendicular to the bar, and through the threaded portion of the bar after it is fitted into the weighted head. Through this bore is inserted a pin, which is sized to fit snugly into the bore. The pin prevents the weighted head from loosening on the bar during use, and permanently attaches the weighted head to the bar. This permanent attachment remedies the safety concerns of the less-secure prior art methods of attaching the weighted heads to the bar. Also, because the bar and weighted heads are formed separately, the present invention overcomes the limitations of prior art methods of forming dumbbells where the weighted heads and bar are formed of a single, integrated material. The present invention allows the manufacturer to form the bar of an attractive, expensive metal, such as stainless steel, while forming the heads of a less expensive metal, such as iron, so long as the weighted heads are to be covered with a resilient, protective material. Because the resilient material covers the bore where the pin is inserted on each weighted head, the bore does not detract from the appearance of the dumbbell.

The present invention also overcomes the limitations of prior art devices having weighted heads with a multi-sided circumference that cut into the coating material applied over the weighted heads. According to the present invention, the weighted heads themselves have a circular circumference. The interior of the coating material is also round to fit snugly over the weighted heads, but the exterior has a multi-sided circumference to prevent rolling. When the dumbbell is dropped or scooted against a surface, there are no sharp edges on the weighted heads themselves to cut or dig into the interior surface of the weighted head. In addition, it has been found that virgin rubber is a particularly desirable material for such coatings, since it is somewhat more durable than most other resilient materials, and it also does not have the strong, unpleasant odor that is associated with low-quality, recycled rubber. Thus the present invention overcomes the problem of prior art devices that cut into the resilient coating material, thereby significantly increasing the life of the coating material and thus the useful life of the dumbbell.

An object of the present invention is, therefore, to provide a barbell with fixed weighted heads that are securely held in place.

A further object of the present invention is to provide a dumbbell that requires no periodic inspection or tightening of bar bolts.

A further object of the invention is to provide a dumbbell that may be manufactured inexpensively yet incorporate the use of expensive, attractive metals for the dumbbell bar.

A further object of the present invention is to provide a barbell that is safer for use by the home barbell user.

A further object of the present invention is to provide a dumbbell that will not easily roll when dropped, but that also does not excessively wear the resilient material coating on the weighted heads.

Further objects and advantages of the present invention will be apparent from a consideration of the following detailed description of the preferred embodiments in conjunction with the appended drawings as briefly described following.

BRIEF DESCRIPTION OF THE DRAWINGS

FIG. 1 is a side elevational view of a preferred embodiment of the invention.

FIG. 2 is a perspective, partial cross-section view of a preferred embodiment of the invention.

DETAILED DESCRIPTION OF THE PREFERRED EMBODIMENTS

Referring now to FIGS. 1 and 2, a preferred embodiment of the present invention may be described. Bar 10 may be straight or curved, but is preferably straight and ergonomically shaped to fit the hand of a user. Also, knurling may be included on the grippable portion of bar 10 to improve the user's grip and thereby improve the safety of the device in use. Threaded ends 12 form the two ends of bar 12. Although bar 10 may be formed of any sufficiently rigid material, it is preferably formed from an attractive metal, such as stainless steel, or may be coated with an attractive coating, such as zinc chromate, to provide a polished look.

Weighted heads 14 fit threadably onto bar 10 at threaded ends 12. Weighted heads 14 have a circular circumference, and thus are roughly disc-shaped. Weighted heads 14 may have a bevel along the interior and exterior edges of the circular circumference. This bevel is preferably smoothed over to avoid sharp edges on the surface of weighted heads 14. Weighted heads 14 may be formed of any sufficiently rigid and dense material, but preferably may be formed of a relatively inexpensive metal, such as iron. Weighted heads 14 may be formed in various sizes to produce dumbbells with any desired total weight.

Once weighted heads 14 are threaded into place on threaded ends 12 of bar 10, bores 16 are drilled through the circumference of weighted heads 14, and then through the threaded end portions 12 of bar 10. Preferably, bores 16 extend only partially through weighted heads 14 on the opposite side of weighted heads 14 from the entry point of each bore 16. Also, bore 16 preferably does not extend completely through weighted head 14. Pins 18 are inserted into each bore 16 and extend through threaded ends 12 of bar 10. The pins thereby lock the weighted heads 14 into place on threaded ends 12. Pins 18 are sized to snugly fit into bores 16. Pins 18 are of sufficiently short length so that they do not extend beyond the edge of weighted heads 14 after being fully inserted into bores 16. Preferably, pins 18 should extend a distance beyond threaded ends 12 on either side of threaded ends 12 within weighted heads 14. Pins 18 should be formed of a material that is sufficiently hard to withstand the shearing forces resulting from use and dropping of the dumbbell; such materials include stainless steel.

After pins 18 are inserted into bores 16, resilient coating 20 is applied to weighted heads 14. Resilient coating 20 fits snugly onto the exterior of weighted heads 14. The circumference of resilient coating 20 is formed in the shape of a multi-sided plate. Preferably, resilient coating 20 is formed in the shape of a six-sided plate, but any other number of sides three or greater may be used. Also, resilient coating 20 preferably has a bevel along the exterior edge.

The present invention has been described with reference to certain preferred and alternative embodiments that are exemplary only and not intended to exclude certain variations and modifications that would occur to those skilled in the art, nor should the embodiments disclosed herein be considered as limiting to the full scope of the invention as set forth in the appended claims.

What is claimed is:

1. A dumbbell comprising:

(a) a bar;

(b) two weighted heads attached to said bar, said weighted heads having a round circumference;

(c) a resilient coating fitted over each weighted head, said resilient coating having a circumference that is multi-sided.

2. The dumbbell of claim 1, wherein the circumference of said resilient coating is six-sided.

3. The dumbbell of claim 1, wherein said resilient coating comprises virgin rubber.

4. The dumbbell of claim 1, further comprising two pins, each pin fitted through a bore travelling through one weighted head and one end of said bar.

5. The dumbbell of claim 4, wherein the ends of said bar and said two weighted heads are threadably coupled together.

6. The dumbbell of claim 5, wherein each of said weighted heads is beveled.

7. The dumbbell of claim 5, wherein said bar is ergonomically shaped.

8. The dumbbell of claim 7, wherein said bar is at least partially knurled.

* * * * *